US008146771B1

(12) United States Patent
Segeleon

(10) Patent No.: US 8,146,771 B1
(45) Date of Patent: Apr. 3, 2012

(54) CONTAINER DELIVERY SYSTEM

(76) Inventor: Richard R. Segeleon, Louisville, KY (US)

( * ) Notice: Subject to any disclaimer, the term of this patent is extended or adjusted under 35 U.S.C. 154(b) by 1198 days.

(21) Appl. No.: 11/780,400

(22) Filed: Jul. 19, 2007

Related U.S. Application Data

(60) Provisional application No. 60/831,748, filed on Jul. 19, 2006.

(51) Int. Cl.
*B65D 90/00* (2006.01)

(52) U.S. Cl. ..... 220/495.06; 206/386; 206/499; 206/600; 206/725; 220/4.28

(58) Field of Classification Search ..... 206/600, 206/386, 499, 725; 220/4.28, 495.06
See application file for complete search history.

(56) References Cited

U.S. PATENT DOCUMENTS 5,765,707 A * 6/1998 Kenevan ..... 220/4.28
5,829,595 A * 11/1998 Brown et al. ..... 206/600
6,024,223 A * 2/2000 Ritter ..... 206/600
7,337,908 B2 * 3/2008 Dedmon ..... 206/600
2005/0199623 A1 * 9/2005 Elder et al. ..... 220/4.28
* cited by examiner

*Primary Examiner* — Anthony Stashick
*Assistant Examiner* — Elizabeth Volz
(74) *Attorney, Agent, or Firm* — Alexander Brackett; Middleton Reuglinger

(57) ABSTRACT

A collapsible container system comprises first and second opposed trays capable of nesting when unopposed, each tray has a tray lip disposed along the perimeter thereof and a plurality of lip slots therein. A wall element has a plurality of sides when unfolded that engage the tray lip of said first and second opposed trays to form a rigid container. A plurality of straps capable of being inserted through the plurality of lip slots in the tray lip whereby the straps are arranged to secure the first and second opposed trays and wall element to each other. Advantageously, the lip slots are vertically positioned at or below an inner supporting surface of a lower tray providing a liquid drainage system. Optionally, the container system may have an inner and outer wall element providing additional strength and rigidity and may also have a liquid container stored therein.

19 Claims, 12 Drawing Sheets

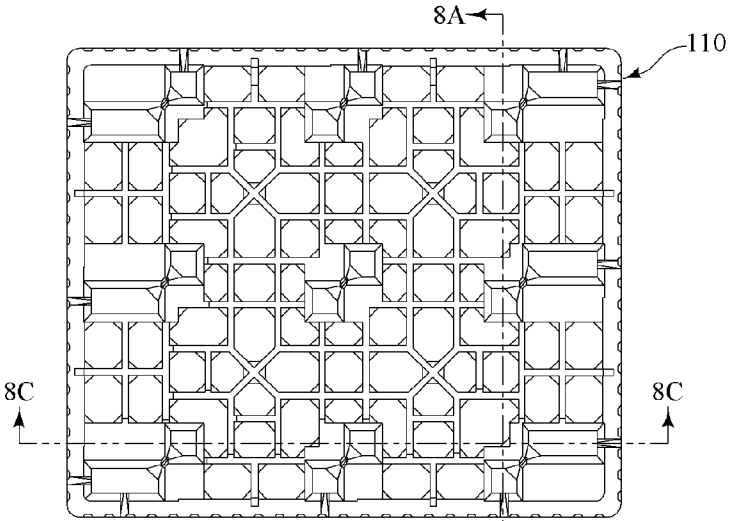
FIG. 8
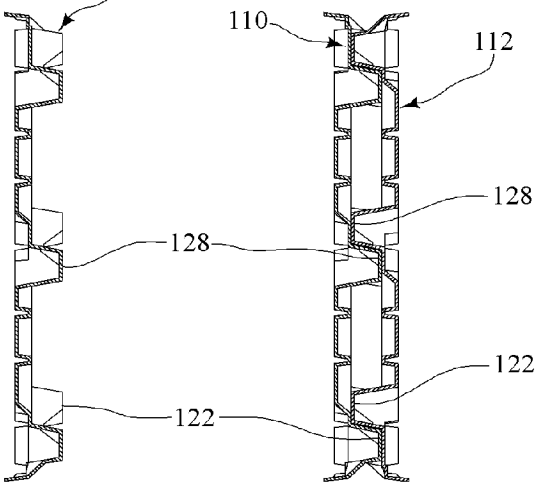
FIG. 8A
FIG. 8B
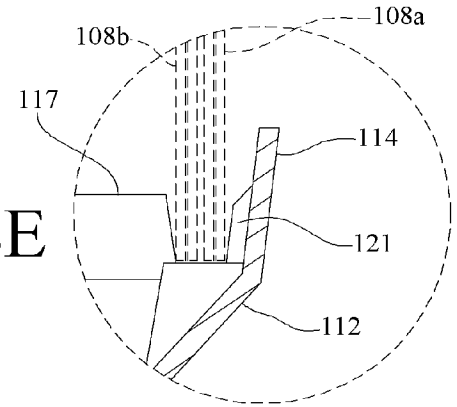
FIG. 8E
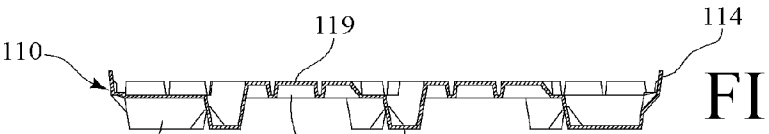
FIG. 8C
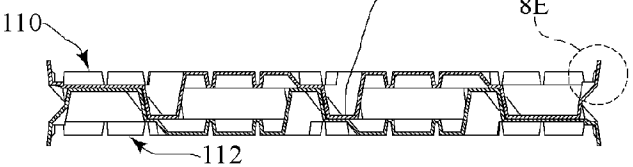
FIG. 8D

CONTAINER DELIVERY SYSTEM

CLAIM OF PRIORITY

This application under 35 USC §119(e) claims priority to, and benefit from, U.S. Provisional Application Ser. No. 60/831,748, filed on Jul. 19, 2006, entitled "Container Delivery System," which is currently pending naming Richard R Segeleon as the sole inventor.

BACKGROUND OF THE INVENTION

Field of the Invention

The present invention relates generally to a container system and more particularly to a modular stackable, collapsible container system utilizing a plurality of containers of varying sizes that are capable of being advantageously interlocked and stacked when assembled. The container system is further capable of being disassembled and stacked in a compact arrangement for "empty" return trip shipping.

SUMMARY OF THE INVENTION

The present invention is a container delivery system that provides a modular container assembly that can be used to enclose and ship a nearly endless variety of items therein. The container system is capable of being used in a variety of shipping modes including but not limited to sea, air and rail. Furthermore, the container system may be manufactured in a variety of sizes to provide compatibility with various shipping standards. For example, the present invention may be configured to be compatible with all U.S. Military delivery platforms such as ISO containers, LHS flat-racks, MTV and LMTV trucks and trailers, HMMMWV's, naval vessels, aircraft pallet systems etc. The invention employs a collapsible extruded polypropylene wall element that employs cross-fluting for strength, as will be discussed further herein below. The wall element comprises a single continuous piece that collapses flat for storage and empty return shipping.

The instant invention further comprises a pair of opposed trays that are interchangeable as top and bottom trays and that accept the edge of a wall element around the perimeter of each tray to form a container. The trays are shaped to permit nesting of a plurality of trays when the container system is unassembled, thus permitting efficient empty return shipping. Furthermore, a tray arranged to be a top tray of a first container interlocks with a bottom tray of a second container when the containers are stacked. This feature of the invention permits for a stable container stack which does not easily shift or move during transport. Additionally, each tray is designed to accept the forks of a fork truck or fork lift from any side thereof, thereby providing for quick and efficient loading and unloading of assembled containers.

Each tray includes a lip having a plurality of slots therein in a plurality of different locations along the lip to permit water drainage from the tray and to enable a plurality of straps to be secured therethrough. The straps serve several functions. First, a plurality of liner straps may be inserted through a horizontally arranged slot or slots in each side of the wall element thence through a tray lip slot to secure each side of the wall element to each top and bottom tray. This arrangement may be repeated on each side of the container. Secondly, a plurality of corner lock straps are provided that are threaded through a plurality of tray corner lip slots and around the corner feet provided in the tray. The corner lock straps around the top and bottom trays are secured to each other to provide a container that is secure and stable under load.

These and other features and objects of the present invention will become apparent from the detailed description of the preferred embodiments, taken in conjunction with the attached drawing Figures.

BRIEF DESCRIPTION OF THE DRAWING FIGURES

FIGS. 8-8E are a plan view and cross-sectional views showing the contour of and inter-locking between trays and the receiving of an inner and outer wall element within a tray.

DETAILED DESCRIPTION

Figure 1:
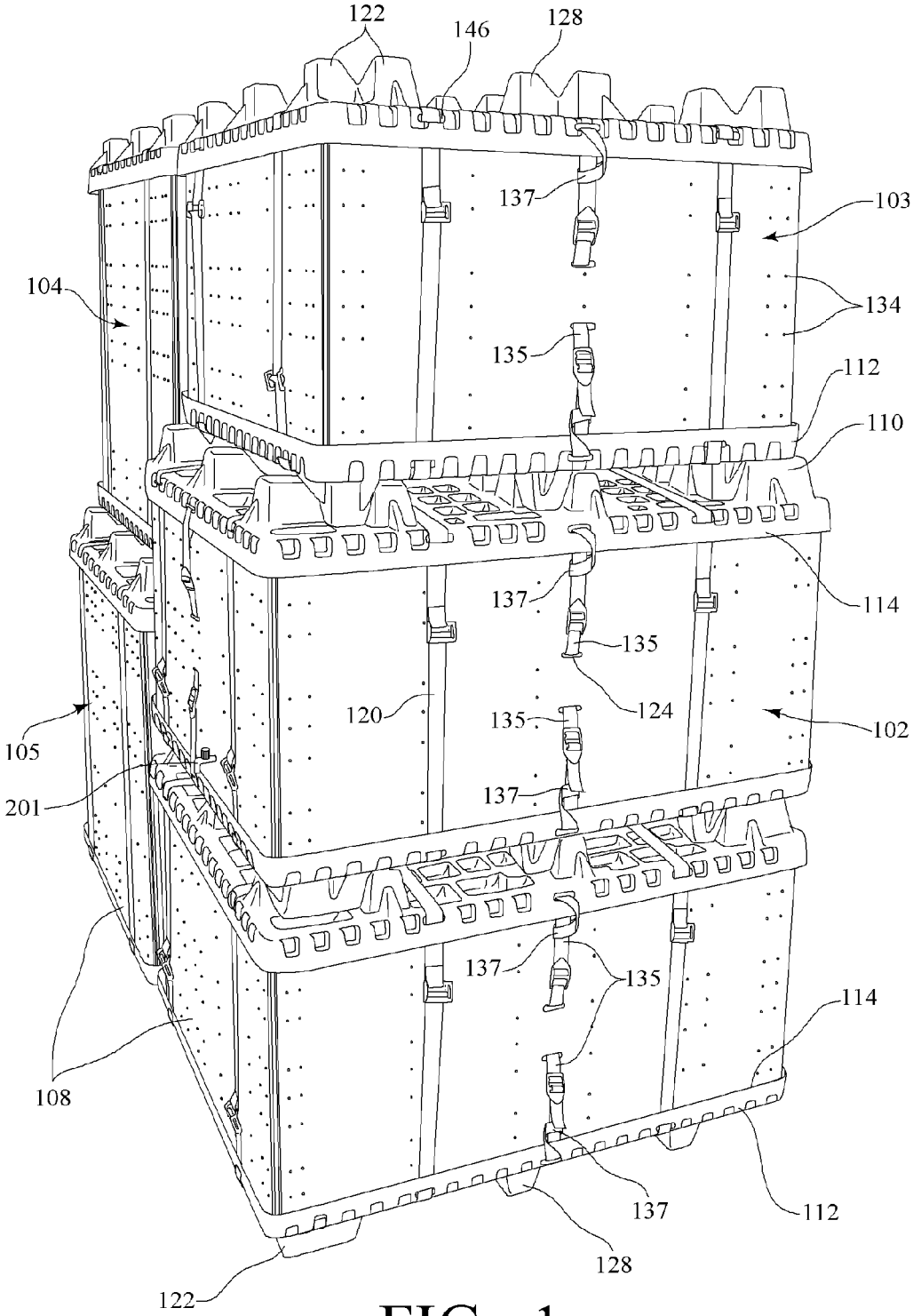
FIG. 1 is a perspective view of a plurality of assembled modular container assemblies of various sizes in a stacked configuration.

Referring now to the drawing Figures, and in accordance with advantageous embodiments of the present invention, a collapsible and reusable container system is described. FIG. 1 shows assembled modular container assemblies 102, 103, 104, and 105, of different sizes and/or configurations, in a stacked configuration. The modular container assemblies may be manufactured in a wide variety of shapes and sizes as required for a particular shipping application. Container assemblies 102, 103, 104, and 105 are but examples of such sizes and configurations as other and more sizes and configurations will become apparent to one skilled in the art upon reading the instant disclosure. For example, container 102 is shown as having an optional spout 201 extending therefrom for accessing liquids stored therein. Each container assembly has at least one wall element 108, a top tray 110, and a bottom tray 112. In the embodiments shown, top tray 110 and bottom trays 112 have a similar configuration; a different designation for each designates placement and orientation with respect to wall elements 108. Wall elements 108 have a lower portion set within a tray lip 114 extending from a perimeter of bottom tray 112 toward top tray 110 and an upper portion set within a tray lip 114 of top tray 110 extending from a perimeter thereof toward bottom tray 112. Corner straps 120 extend about a wall element 108 and around corner feet 122 which extend outward from an outer surface of top and bottom trays 110 and 112. A plurality of optional liner straps 135 are shown inserted through a horizontally arranged slots 124 in sides of the wall elements 108 thence through tray lip slots 146 to secure each side of wall element 108 to each top tray 110 and bottom tray 112.

Top tray 110 and bottom tray 112 are opposed to one another having facing inner sides in the assembled configuration. Opposed trays 110 and 112 are interchangeable as top and bottom trays and accept the edge of wall element 108 around the perimeter of each tray 110 and 112 to form a container assembly. Each tray 110 and 112 includes a lip 114 having a plurality of slots 146 therein in a plurality of different locations along lip 114 to permit water drainage from bottom tray 112 and to enable a plurality of straps 120 and 135 to be secured therethrough. Straps 120 and 135 serve several functions. First, a plurality of liner straps 135 may have a portion inserted through horizontally arranged slot 124 or slots in each side of wall element 108 thence through a tray lip slot 146 and secured thereto with loop 137. This secures each side of the wall element 108 to each top tray 110 and bottom tray 112. This arrangement may be repeated on each side of an assembled container. Secondly, a plurality of corner lock straps 120 are provided that are threaded through a plurality of tray lip slots 146 and around corner feet 122 provided in top and bottom trays 110 and 112. Corner lock strap 120 extending around top tray 110 and bottom tray 112 is secured at ends with a buckle to provide a container that is secure and stable under load.

Figure 2:
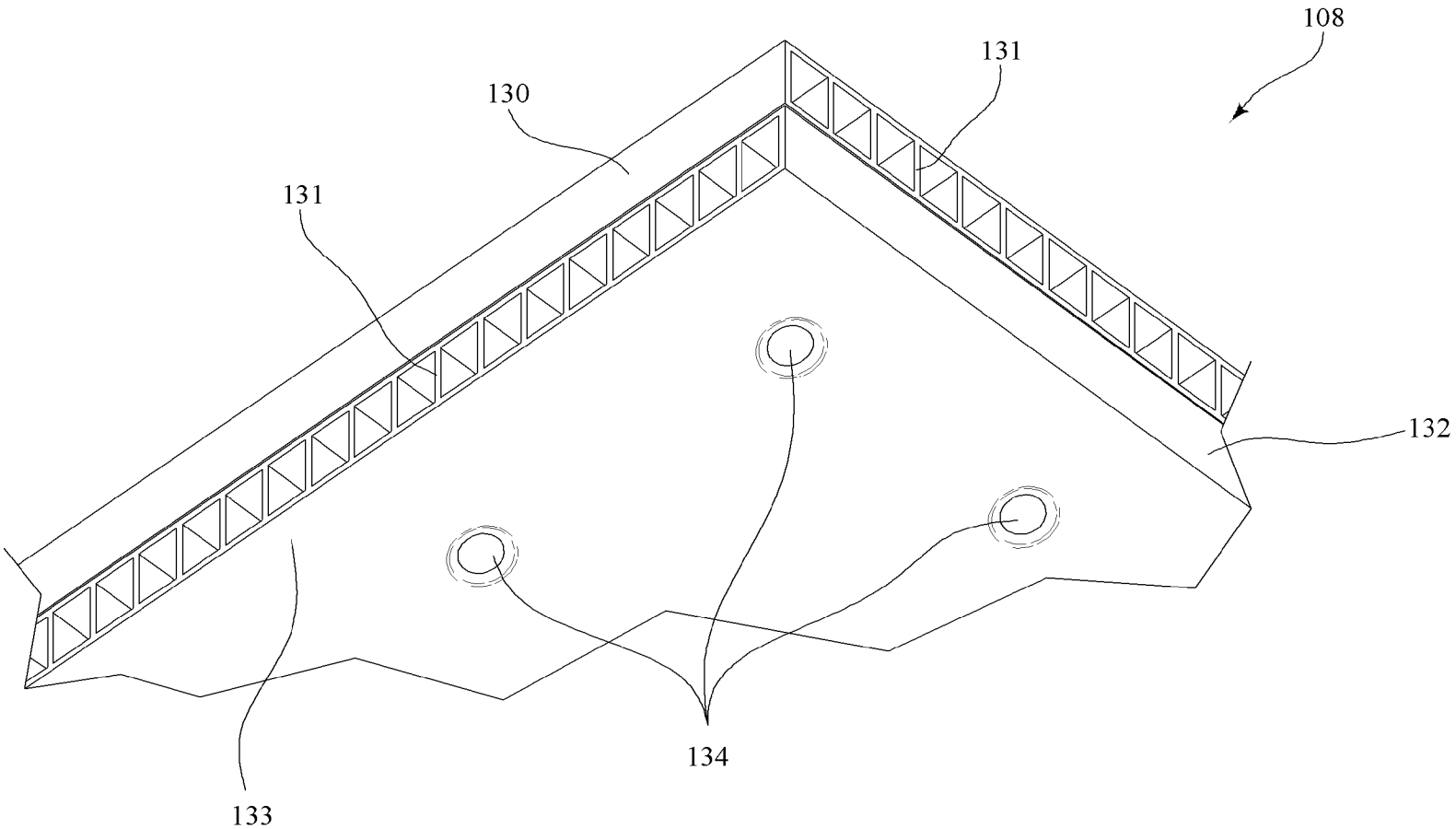
FIG. 2 is a cut-away view of a cross fluted wall element showing the configuration of an inner or outer wall element.

FIG. 2 shows a section of an embodiment of wall element 108 having a cross fluted configuration. A pair of planar sheets of material 133 joined with flutes 131 provide a fluted layer. Wall element 108 may be manufactured of, for example, a pair of cross-fluted polyethylene layers 130 and 132. Each polyethylene layer 130 and 132 may be arranged such that the direction of the fluting of each layer is orthogonal to the other, thereby providing a wall element 108 having superior strength and rigidity. Cross-fluted layers 130 and 132 are advantageously sonically welded at points 134.

Figure 3A:
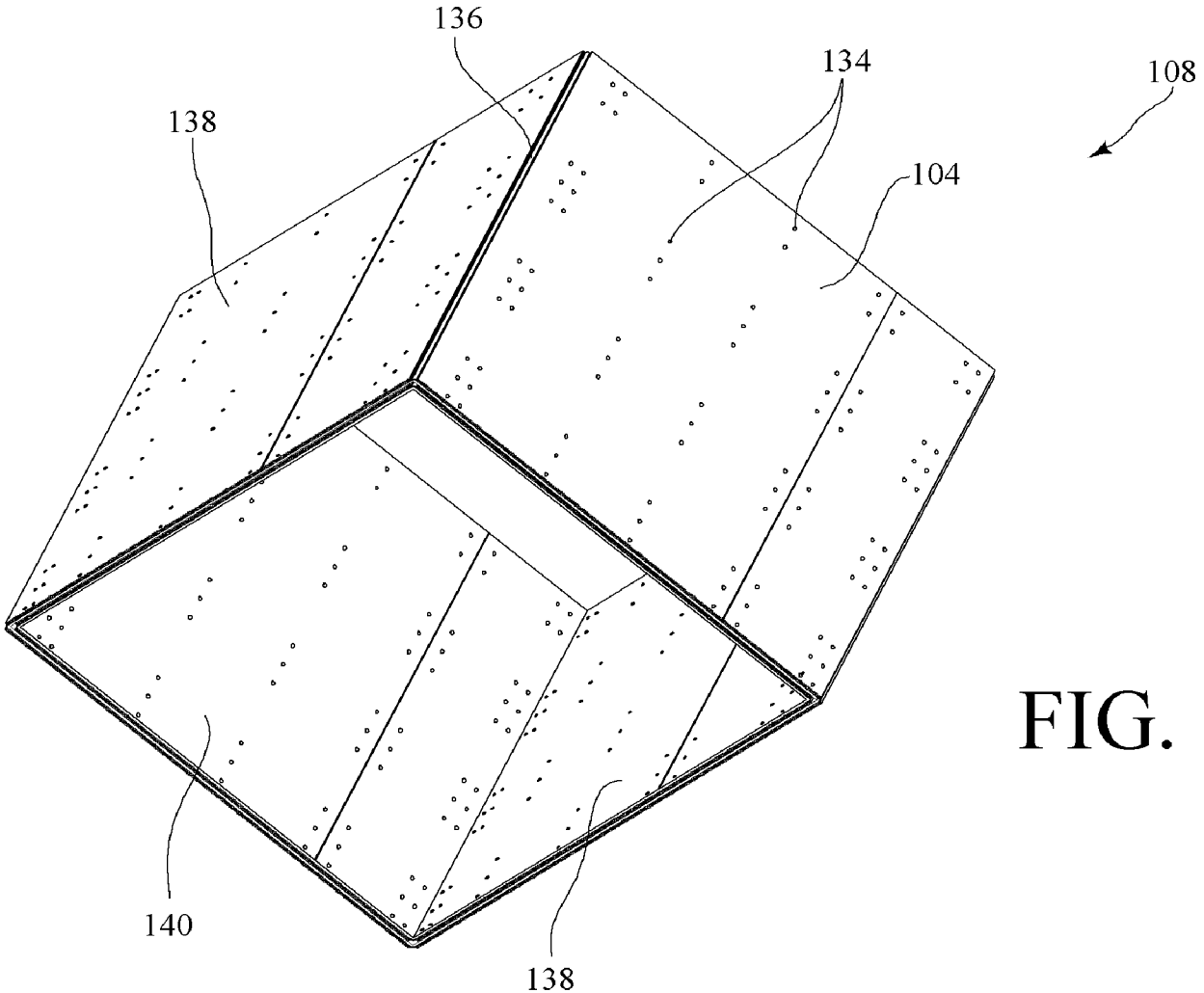
FIGS. 3A-3C are perspective views of an inner or outer wall element of FIG. 2 showing an embodiment of a collapsible configuration of the wall element.
Figure 3B:
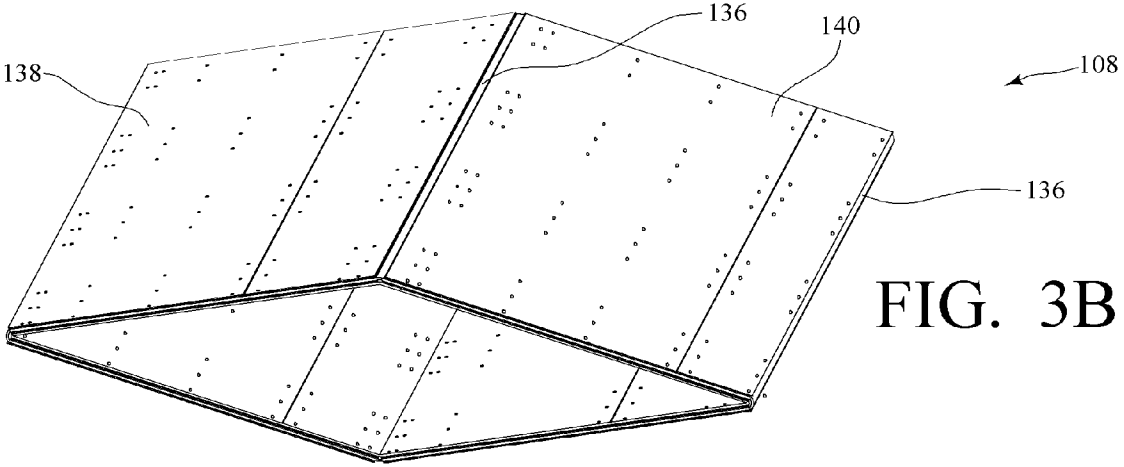
Figure 3C:
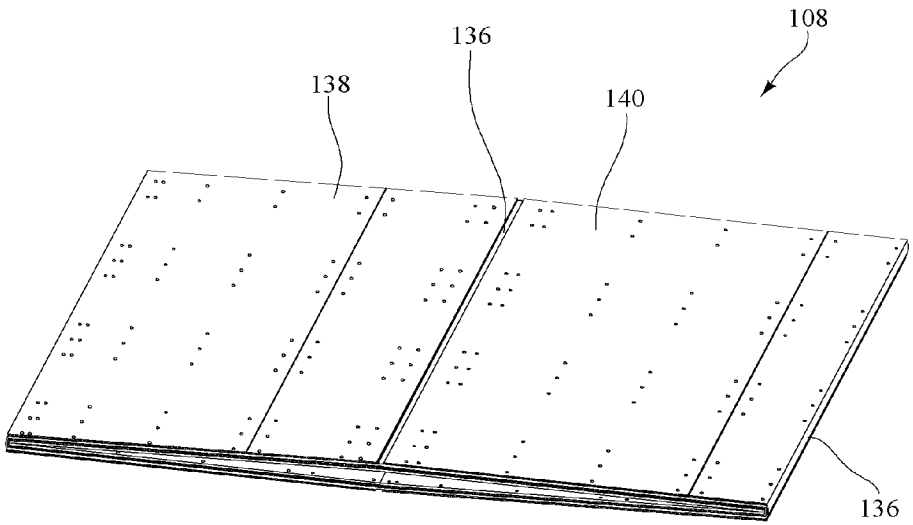

FIGS. 3A-3C show an embodiment of a collapsible configuration of a wall element 108. The modular container assembly comprises collapsible wall element 108 having a thickness, a top edge, a bottom edge, and a plurality of separations and/or gaps 136 linearly extending from the top edge to the bottom edge. Each separation or gap 136 has a depth into an inner or outer surface or layer, 130 or 132 as shown in FIG. 2, of wall element 108 less than the thickness of wall element 108 and spaced thereabout forming the collapsible configuration. At each corner portion, wall element 108 has a separation or gap 136 in a vertically fluted polyethylene layer 130 or 132 that permits the corners 136 of wall elements 108 to collapse and fold substantially flat when not in use. In an un-folded configuration, as shown in FIG. 3A, wall element 108 has a pair of adjacent sides, 138 and 140. FIGS. 3B and 3C show the folding of wall element 108 wherein adjacent sides 138 and 140 are folded from an orthogonal configuration to a planar configuration as shown in FIG. 3C. This feature is particularly useful when return shipping empty containers, since wall elements 108 may be easily folded reducing space. Advantageously the size of sides 138 and 140 are such that a plurality of folded wall elements 108 are sized to fit and be shipped inside an assembled container.

Figure 4:
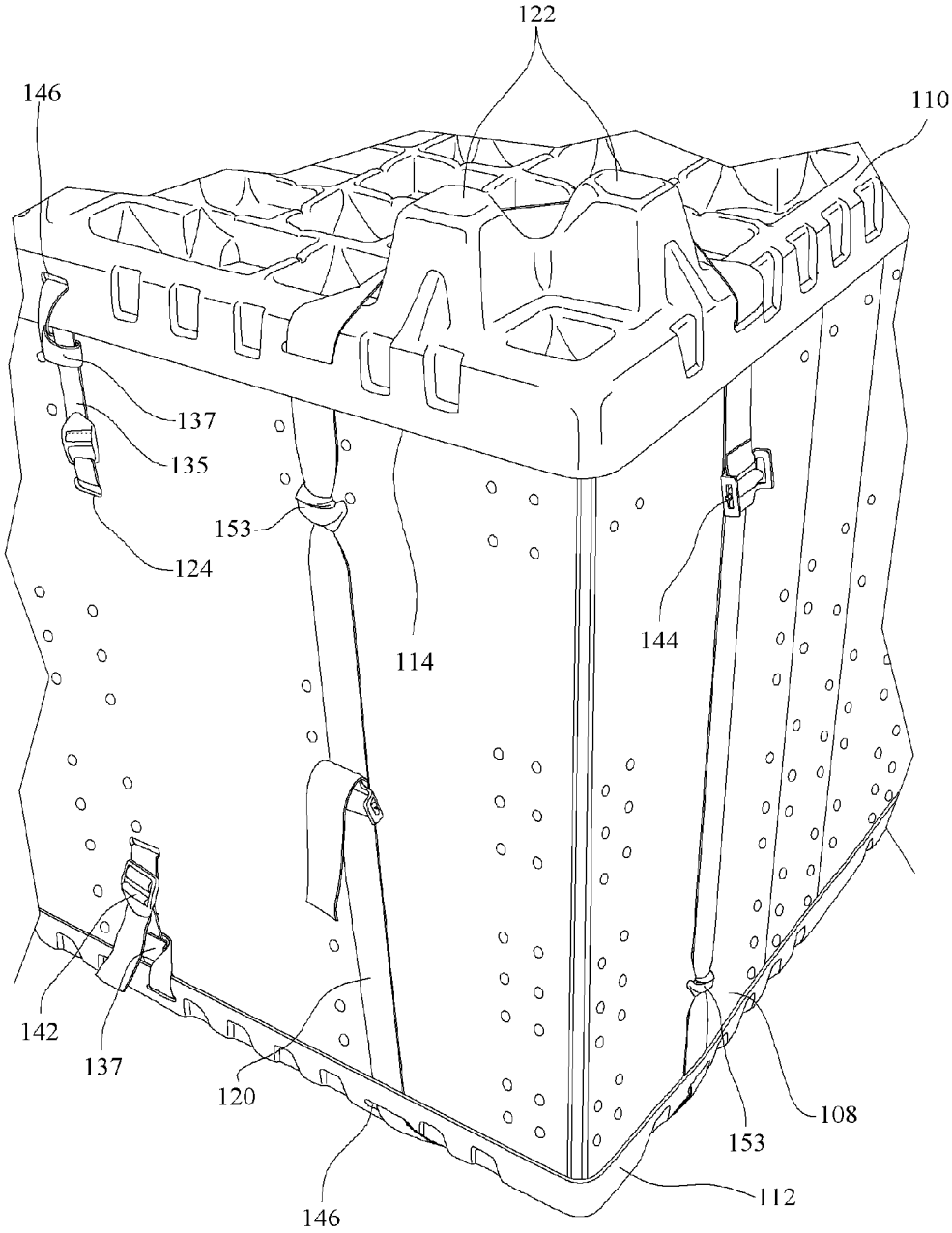
FIG. 4 is a perspective cut-away view of a corner of a modular container assembly of FIG. 1 showing a corner strap securing a top and bottom tray with a wall element.
Figure 5:
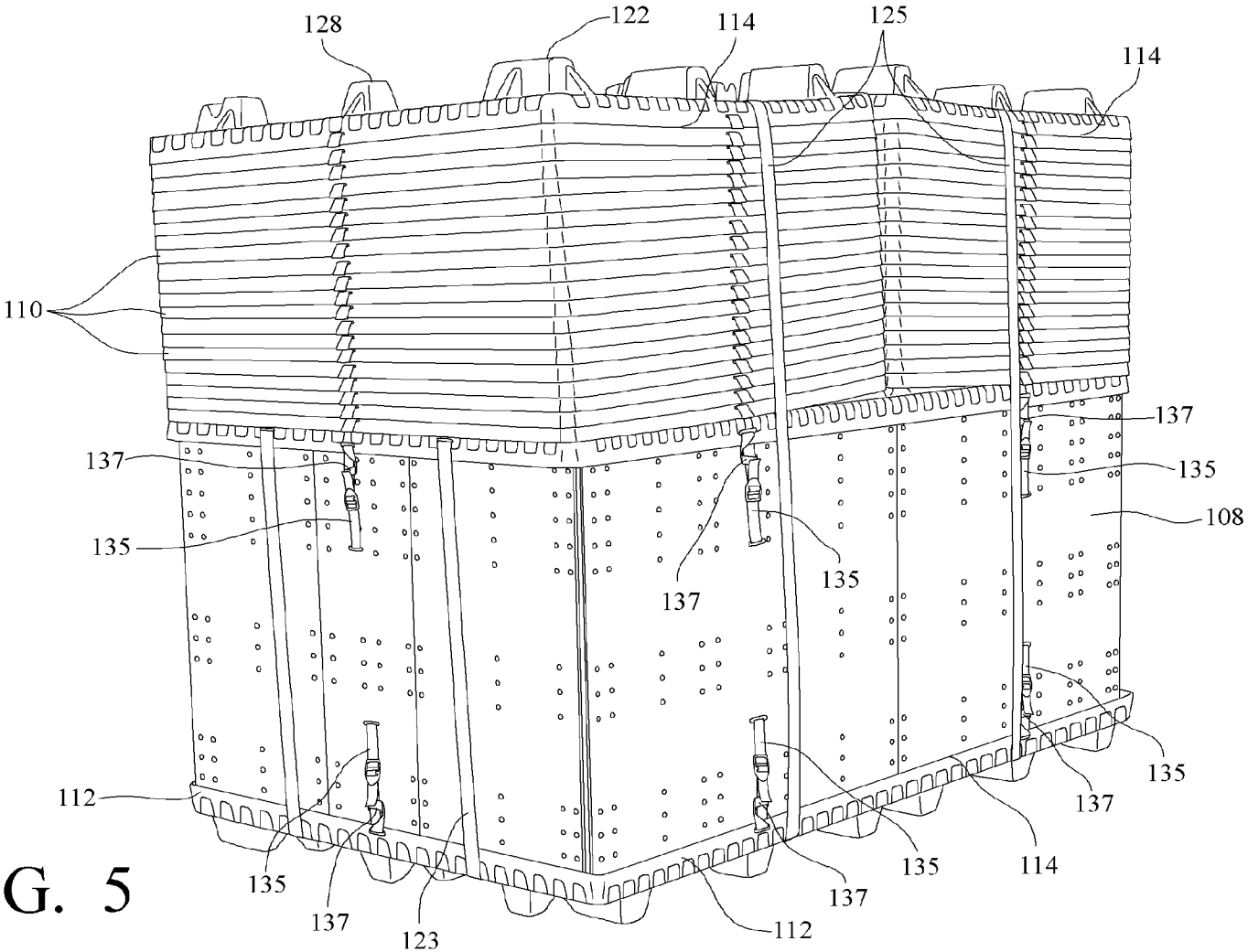
FIG. 5 is a perspective view of a container assembly having a plurality of trays nesting and secured to a top tray for return shipping.

FIG. 4 shows a portion of a modular container assembly having a liner strap 135 and a corner strap 120 securing a top tray 110 and bottom tray 112 with wall element 108. Bottom tray 112 is positioned with its feet on a flat surface; wall element 108 is then placed with its bottom edge engaged by tray lip 114. Then opposed tray 110 is placed on the top edge of wall element 108 so that lip 114 engages the top edge to form a container that is enclosed on all sides thereof. Top and bottom trays 110 and 112 are interchangeable for a given container size and shape. Wall element 108 may have one or more horizontal slots 124 in side portions thereof which may be engaged by straps 135 or other fastening apparatus. Trays 110 and 112 comprise a plurality of slots 146 disposed in tray lips 114. In the embodiment of the invention shown in FIG. 4, each tray has a pair of slots 146 disposed in tray lip 114 proximate the corner portion thereof and further has a slot 146 disposed in the tray lip between each corner. Slots 146 are situated in tray lip 114 such that they are located at an elevation at or below an upper inner surface of bottom tray 112, thereby enabling the slots to drain water that may collect in bottom tray 112. When tray 110 is in the top position, slots 146 are below the upper edge of wall element 108 thereby inhibiting water from entering the inside of the assembled container. Furthermore, tray slots 146 are designed to accept straps 135 and 120 to secure trays 110 and 112 to wall element 108 and to each other. In an advantageous embodiment of the invention the slip strength of buckles 142 utilized to join straps 135 is less than the break or tear strength of lip slots 146 and wall slots 124. Accordingly, when a force is applied to a strap that exceeds the tear strength of wall element 108 or a portion of tray 110 and 112 about slot 146, the strap will release from the buckle, thereby preventing damage to the container system.

The embodiment shown here also comprises a plurality of corner lock straps 120. Corner lock strap 120 having a buckle 144 on at least one end thereof is thread into a corner lip slot 146, around a plurality of tray feet 122, and back through another corner lip slot 146. Optionally, a free (non-buckle) end of a strap may be tied in a slip knot 153 to prevent it from sliding back through a slot 146. Advantageously, a corner lock strap 120 is positioned about each corner of opposed trays 110 and 112. At least one free end of a corner lock strap 120 is threaded through a buckle end of corner lock strap 120 on the opposed tray to secure top and bottom corners of trays 110 and 112 to each other. Corner lock straps 120 in conjunction with the cross-fluted wall elements 108 and top and bottom trays 110 and 112 provide a container that is extremely stable and resistant to buckling or deformation under load.

The present invention further comprises a plurality of liner straps 135. Liner straps 135 may comprise conventional woven webbing straps having buckles 142 on both ends thereof. In an advantageous embodiment, a liner buckle strap 135 engages a plurality of horizontally disposed slots 124 in each side of wall element 108 such that buckles 142 are accessible on the outside of the container as shown. Advantageously, buckles 142 are larger than slots 124 prohibiting liner buckle strap 135 from sliding into the interior of the container or behind wall element 108.

Additionally, strap 135 may have a loop 137 on one or both ends thereof and threaded through a tray lip slot 146, generally located above and below the optional horizontally arranged slots 124 in the sides of wall element 108. In the embodiment shown in FIG. 4, strap 135 is threaded through its own loop 137 to secure it to trays 110 and/or 112. The free ends of the portions of tray loop straps 135 having loops 137 are then secured to buckle 142 on a central portion of strap 135 extending into slots 124. This arrangement may be repeated at each side of trays 110 and 112, providing a system wherein top tray 110 is secured to bottom tray 112 at each side.

The collapsible container system shown in FIG. 4 comprises first and second opposed trays 110 and 112 capable of nesting when unopposed, each tray 110 and 112 has a tray lip 114 disposed along the perimeter thereof extending toward the other opposed tray and has a plurality of strap slots 146 therein, each tray 110 and 112 also has a plurality of feet 122 formed therein extending away from the other opposed tray with at least one foot 122 proximate each corner thereof. Wall element 108 is advantageously comprised of a cross-fluted material and is un-folded to provide a plurality of sides that engage in a tray lip 114 of first and second opposed trays 110 and 112 to form a rigid container. A plurality of straps 135 and 120 are inserted through the plurality of lip slots 146 in tray lips 114 whereby straps 135 and 120 are arranged to secure first and second opposed trays 110 and 112 and wall element 108 to each other. Straps 120, proximate outer edges of sides of wall element 108 being suitable to join and extend about adjacent sides of wall element 108 and about at least one foot 122 proximate opposed corners of opposed trays 110 and 122.

Trays 110 and 112 are shaped to permit nesting of a plurality of trays when the container system is unassembled, thus permitting efficient empty return shipping. Upper and lower trays 110 and 112 each have a first and second side surface where the first surface of each tray has a plurality of feet 122 and 128 extending therefrom. Feet 122 and 128 are positioned to accept forks of a forklift therebetween, to interlock with feet 122 and 128 extending from the first surface of another tray. The first surface of at least one of an upper or lower tray, 110 or 112, has a nesting configuration with the second surface of the other of said upper or lower tray, 112 or 110. Each tray 110 and 112 has a tray lip 114 extending from the perimeter of the tray about the second surface with a configuration adapted to accept wall element 108 in a non-collapsed state. Tray lips 114 have a plurality of slots 146 aligned with or between the first and second surfaces and are adapted to accept straps.

Figure 6:
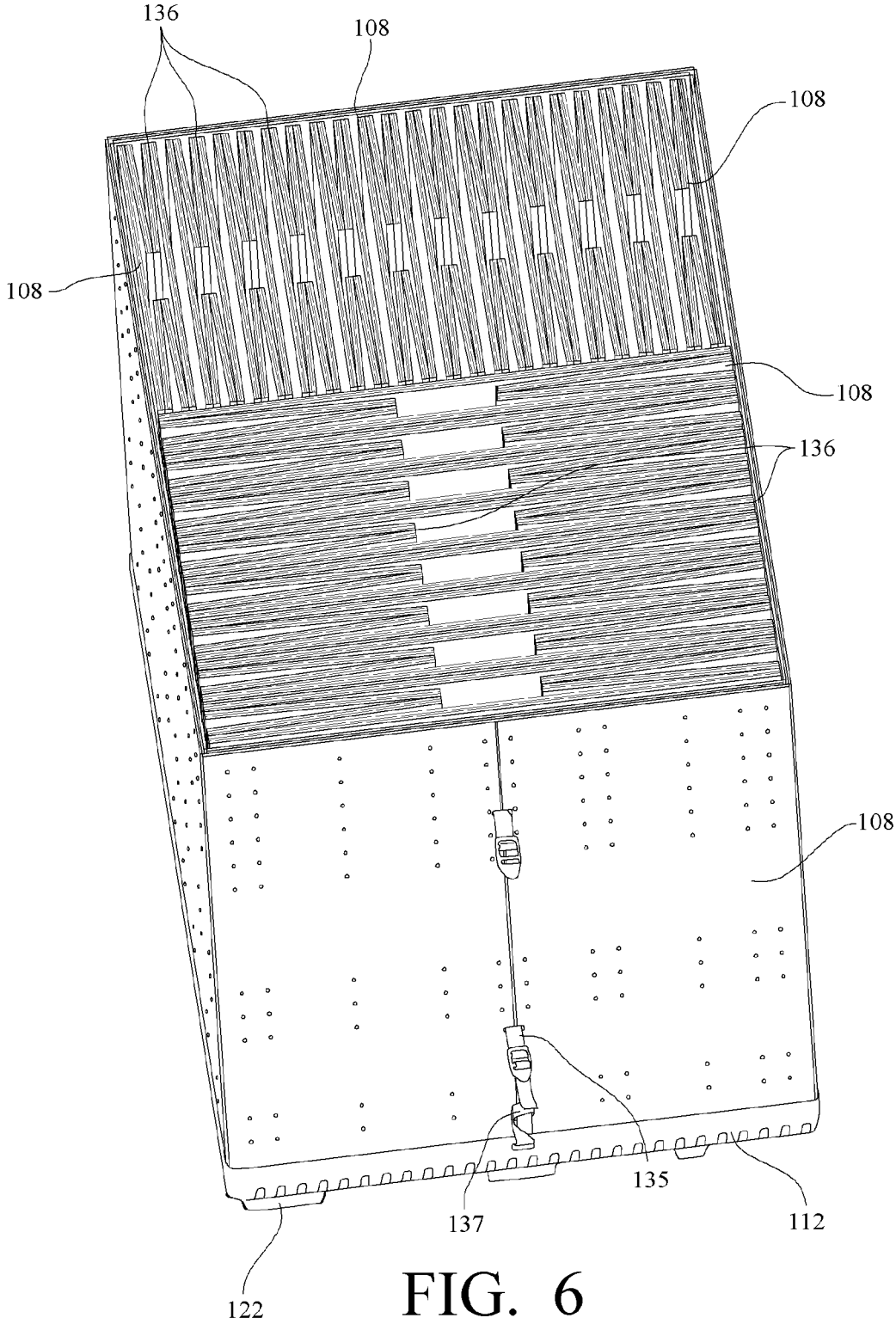
FIG. 6 is a perspective view of a container assembly having a plurality of wall elements with an alternative embodiment of a collapsible configuration placed therein for return shipping.

FIG. 6 shows a container assembly having a plurality of wall elements 108 with an alternative fold configuration folded and placed therein for return shipping. This embodiment of collapsible wall element 108 has a thickness, a top edge, a bottom edge, and a plurality of separations and/or gaps 136 linearly extending from the top edge to the bottom edge. Each separation or gap 136 has a depth into an inner or outer surface or layer, 130 or 132 as shown in FIG. 2, of wall element 108 less than the thickness of wall element 108 and spaced thereabout forming the collapsible configuration. At each corner portion and mid-way between corner portions of opposite sides, wall element 108 has a separation or gap 136 in a vertically fluted polyethylene layer 130 or 132 that permits the corners of wall elements 108 to fold inwardly and opposite sides to fold in a central portion when not in use forming a substantially flat wall element 108.

Figure 7:
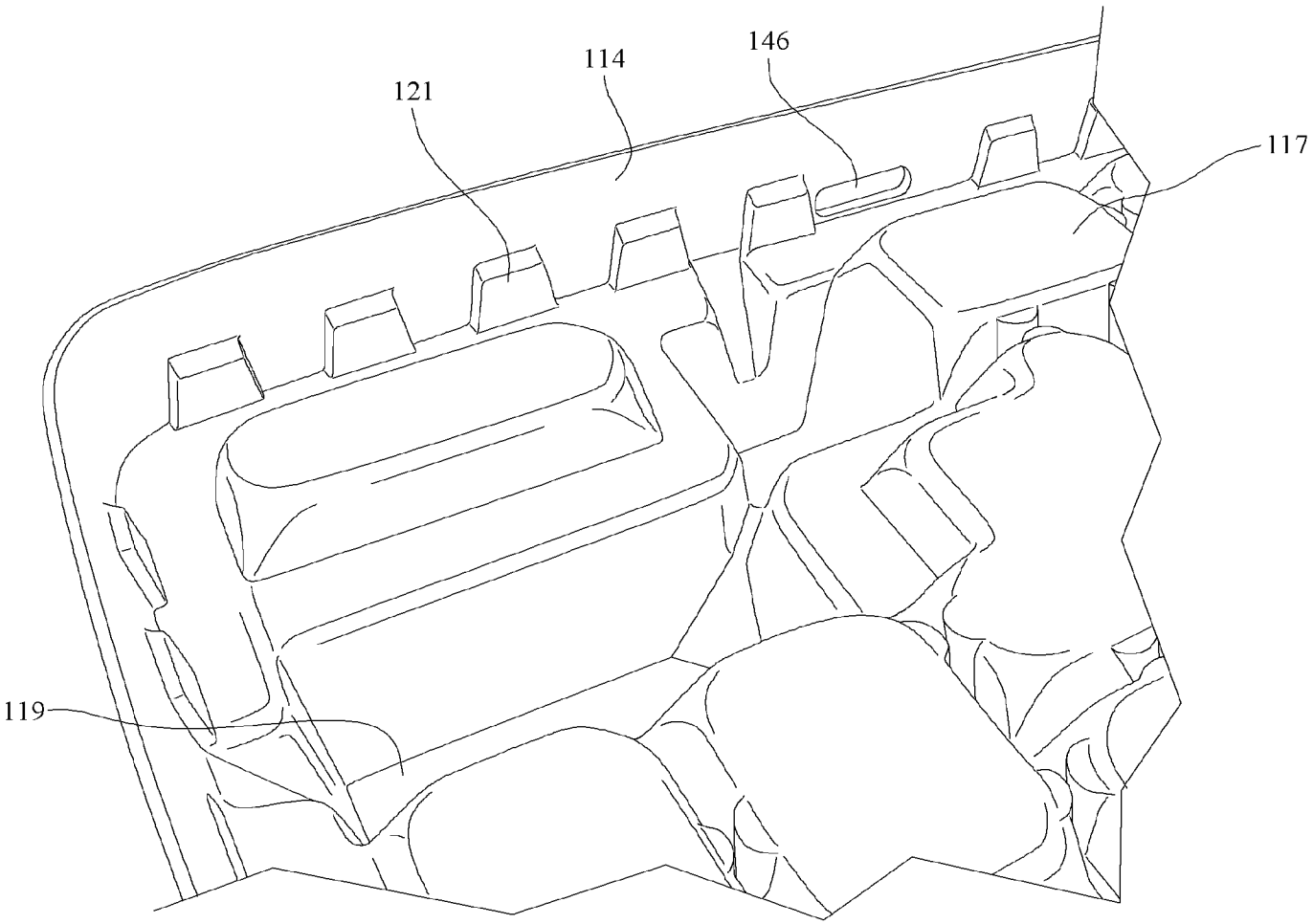
FIG. 7 is a perspective cut-away view of the inner side of a tray showing lip slots and a water drainage system.

FIG. 7 shows the inner side of a tray having lip slots 146 in an advantageous location within tray lips 114 providing a water drainage system. The tray has a tray lip 114 extending from the perimeter thereof about second or inner surface 117 with a plurality of slots 146 aligned with or between first or outer surface, on a bottom side of indented portions 119, and an inner or second surface 117. A portion of the tray extending between tray lips 114 has a corrugation or other non-flat configuration wherein the top surface thereof forms an inner surface 117 which supports the contents of the container. The bottom surface of the indented portions 119 forms an outer surface which supports the container. The corrugation or non-flat configuration of the portion of the tray extending between tray lips 114 is such that water may migrate or flow from a central area to a slot 146 wherein the water can drain from a lower tray.

Figure 10:
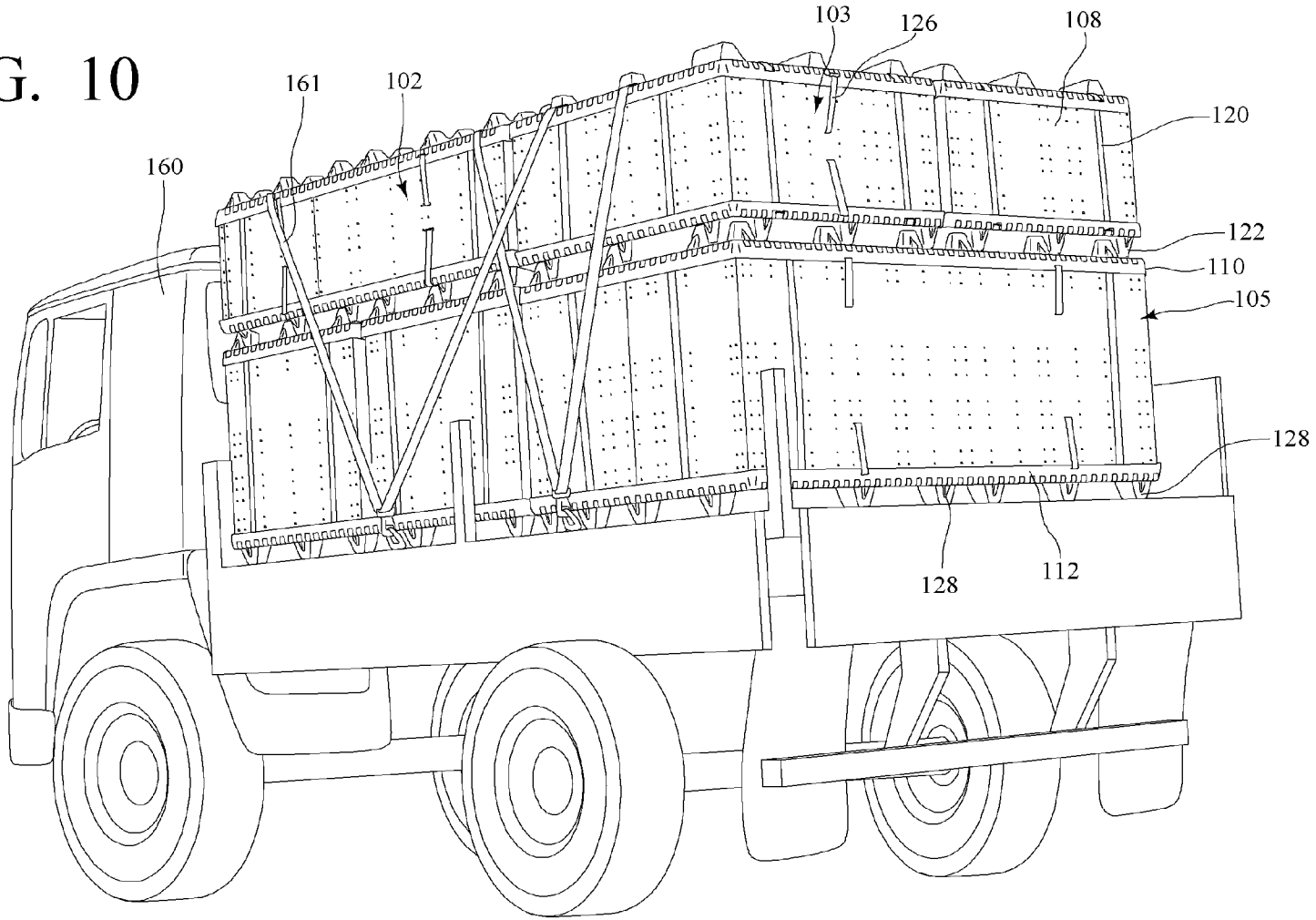
FIG. 10 is a perspective view of a plurality of assembled modular container assemblies of various sizes in a stacked configuration readied for transport.

FIGS. 8-8E show the contour of and inter-locking between trays 110 and 112 and the positioning of a double wall element system within a tray lip 114. The tray feet 122 and 128 of opposed trays 110 and 112 are offset from one another to permit stacked assembled containers to have trays with interlocking feet, as best shown in FIGS. 8B and 8D. This feature of the invention provides for a container system wherein containers may be easily stacked in a stable configuration that is resistant to shifting during transport. The tray feet 122 and 128 are arranged on each tray 110 and 112 in a spaced fashion that permits a standard fork lift to engage each container between tray feet 122 and 128 from any side thereof as shown in FIGS. 8A through 8D. This configuration provides quick and efficient loading and unloading of assembled containers. In a yet further embodiment of the invention the feet of the trays are arranged thereon to enable trays of differing sizes and widths to both nest and interlock as shown in FIGS. 1 and 10, thus enabling the present container system to be used in a wide variety of sizes.

A top tray 110 is positioned on a wall element 108 having feet 122 and 128 extending upwardly. Then a bottom tray 112 having a wall element extending upwardly and feet 122 and 128 extending downwardly is placed onto top tray 110 in an interlocking configuration as shown in FIGS. 8B and 8D.

FIG. 8E shows a portion of a container assembly having an inner wall element 108*b* and an outer wall element 108*a* set within lower tray 112. Inner wall element 108*b* has an outer perimeter that is less than an in inner perimeter of outer wall element 108*a* providing both wall elements to seat within tray lip 114. Tray lip 114 has a plurality of inwardly depending flanges 121 that help to guide wall elements 108*a* and 108*b* about inner surface 117. Flanges 121 also increase the strength and rigidity of the outer portion of trays 110 and 112 and decrease any tendency that tray lip 114 may have to warp bend. Note that the top and bottom trays 110 and 112 disclosed herein are interchangeable for a given container size and shape. Note further that the instant invention may be manufactured in a wide variety of shapes and sizes as required for a particular shipping application.

Figure 9:
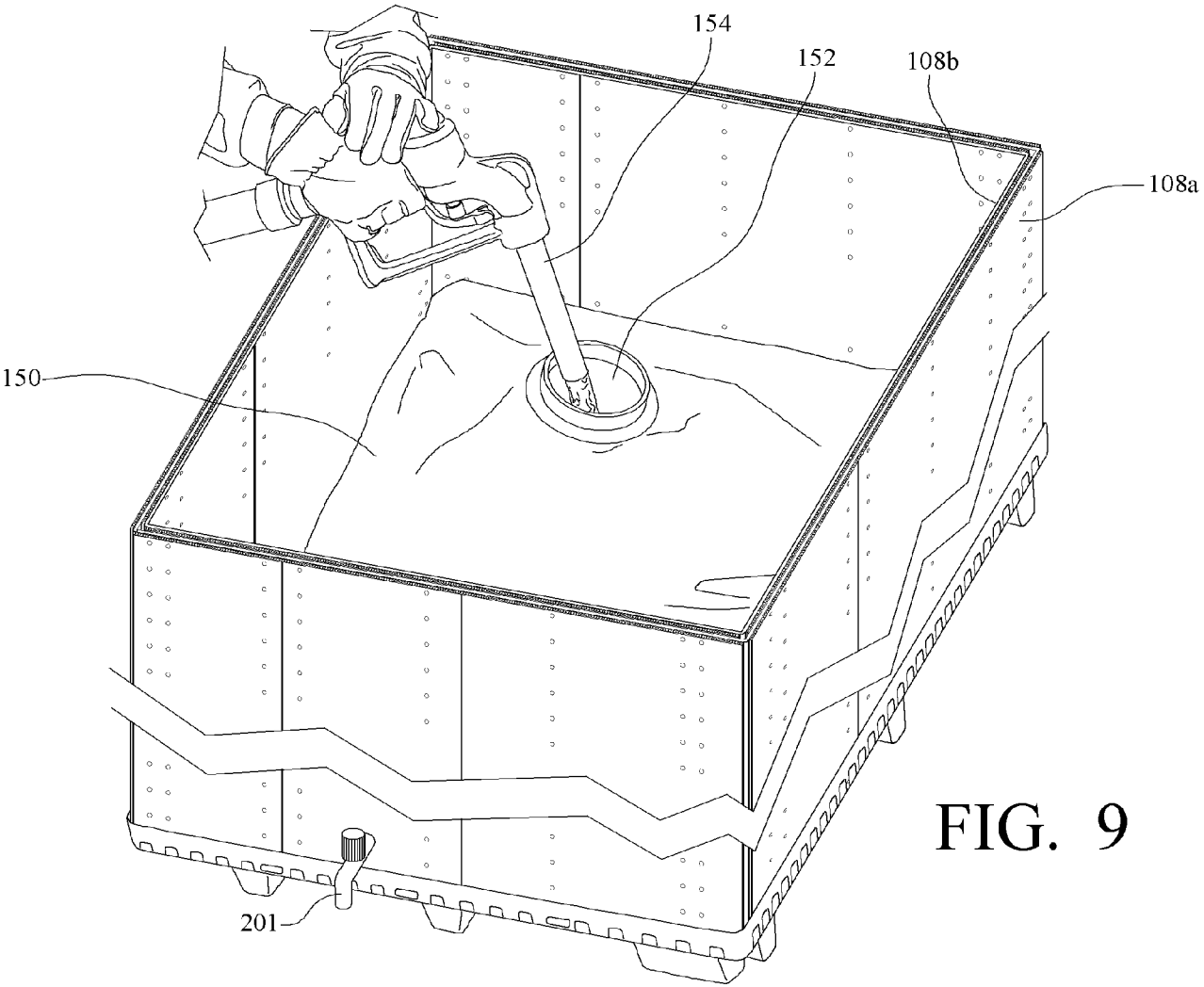
FIG. 9 is a perspective cut-away view showing an embodiment of the assembled modular container adapted for liquid transport.

FIG. 9 shows an embodiment of an assembled modular container adapted for liquid transport. Inner sidewall 108*b* and outer sidewall element 108*a* are fit within lower tray 112 and have aligning apertures 203 in a side thereof. Within inner wall element 108*b* is a collapsible liquid container 150 in the form of a bladder-type bag. Liquid container 150 may be comprised of a material suitable to hold fuel, water, or other liquid for transport. Liquid container 150 has at least one top port 152 for filling as shown with nozzle 154 and at least one side port 201 extending through apertures 203 for access of a liquid disposed in the container system. Once a top tray is secured to the container as detailed herein above, bag 150, which may contain potable water or fuel to name but two examples, may be transported safely and securely. Furthermore, side port 201 can be accessed to attach a valve or hose once the container is at its destination. It is understood that bag 150 may have a plurality of inlets and outlets with the container system by simply adding a suitably sized aperture in wall elements 108*a* and 108*b* in the necessary location. Furthermore, a single wall element, 108*a* or 108*b*, may be used rather than both wall elements as shown in FIG. 9.

FIG. 10 shows a plurality of assembled modular container assemblies, of various sizes, in a stacked configuration readied for transport on transport vehicle 160. Trays 110 arranged to be a top tray of a lower container interlocks with a bottom tray 112 of a second container with feet 122 and 128 when the containers are stacked as shown. This permits for a stable container stack which does not easily shift or move during transport. Straps 120 and 135 are utilized to hold top and bottom trays 110 and 112 about wall assemblies 108. Straps 161 are shown to secure the container assemblies to the bed of the transport vehicle 160. Also shown here is the ability to stack various size containers of the present invention in various orientations with respect to one another. For example, two containers 103 are interlocked in a transverse relationship with container 105 and container 102 interlocks with two containers.

Figure 11:
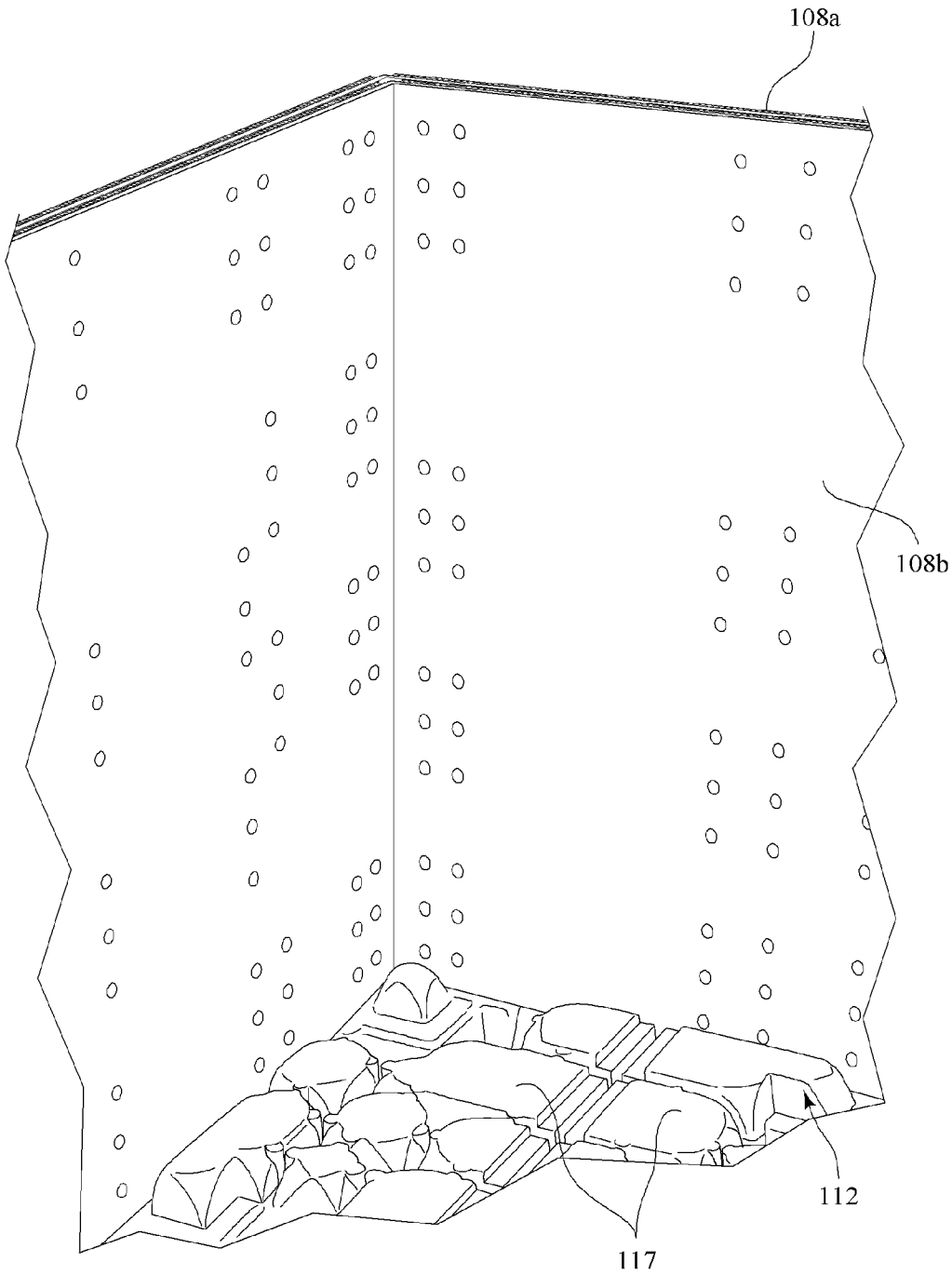
FIG. 11 is a perspective cut-away view of an inner corner portion of an assembled modular container showing cooperation between a wall element and a bottom tray.

FIG. 11 shows an inner corner portion of an assembled modular container having a first and second wall element 108*a* and 108*b*. Bottom tray 112 has a tray lip extending from the perimeter thereof about second or inner surface 117 on the outer side of outer wall element 108*a* holding inner and outer wall elements 108*a* and 108*b* proximate raised inner or second surface 117. Materials or products stored within the container assembly rest on inner surface 117 which has corrugations or channels formed therein allowing any accumulated water or other liquid to flow to the tray lips where the liquid may escape the container assembly through a tray lip slot.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

I claim:

1. A collapsible container system comprising:

first and second interchangeable opposed trays capable of nesting when unopposed, each of said trays having a tray lip disposed along the perimeter thereof and a plurality of lip slots therein;

a wall element comprised of a pair of polyethylene layers having a plurality of sides that engage the tray lip of said first and second opposed trays to form a rigid container having the plurality of lip slots disposed in each side of said wall element for accepting a strap therethrough; and a plurality of straps capable of being inserted through the plurality of lip slots in the tray lip, whereby said straps are arranged to secure said first and second opposed trays and said wall element to each other.

2. A collapsible container system as claimed in claim 1 wherein said opposed trays comprise a plurality of spaced tray feet and a plurality of complementary foot recess portions, wherein the tray feet engage the recess portions of nesting trays, and whereby the tray feet of opposed trays interlock with each other when stacked.

3. A collapsible container system as claimed in claim 1 further comprising:

at least one aperture in said wall element; and a bladder disposed within said wall element between said opposed trays, said bladder having an inlet port and an outlet port generally aligned with the at least one aperture in said wall element.

4. A collapsible container system as claimed in claim 1 wherein the polyethylene layers of said wall element are cross-fluted to impart rigidity thereto.

5. A collapsible container system as claimed in claim 4 further comprising:

a wall element having corner portions comprised of a single polyethylene layer to permit bending, whereby said wall element is capable of being folded substantially flat.

6. A collapsible container system as claimed in claim 1 wherein each of said trays comprises four corner portions, and wherein each tray lip includes a pair of lip slots proximate each corner portion for accepting a strap.

7. A collapsible container system as claimed in claim 6 wherein each tray lip includes at least one lip slot spatially oriented between the corner portions thereof.

8. A modular collapsible container assembly comprising:

a collapsible wall element having a thickness, a top edge, a bottom edge, and a plurality of separations linearly extending from said top edge to said bottom edge, each of said plurality of separations having a depth into an inner or outer surface of said wall element less than said thickness of said wall element and spaced about said wall element forming said collapsible configuration; and an interchangeable upper and lower tray, said upper and said lower tray each having a first and second side surface, said first surface of each of said trays having a plurality of feet extending therefrom, said feet being spaced to accept forks of a forklift therebetween from any side of said upper and lower tray and to interlock with feet extending from said first surface of another of said trays when nested therewith, said first surface of at least one of said upper or lower tray having a nesting configuration with said second surface of the other of said upper or lower tray, each of said trays having a tray lip extending from the perimeter of said tray about said second surface with a configuration adapted to accept said wall element in a non-collapsed state, said tray lip having a plurality of slots aligned with or between said first and second surfaces and being adapted to accept straps.

9. The collapsible container system as claimed in claim 8 wherein said wall element is comprised of cross-fluted polyethylene layers.

10. The collapsible container system as claimed in claim 8 wherein said wall element is an inner wall element and has an outer surface substantially surrounded by an outer wall element.

11. A collapsible container system as claimed in claim 8 wherein each of said trays comprises four corner portions, and wherein each tray lip includes a pair of lip slots proximate each corner portion for accepting a strap.

12. A collapsible container system as claimed in claim 8 further comprising the plurality of slots are disposed in each side of said wall element for accepting a strap therethrough.

13. A collapsible container system as claimed in claim 8 further comprising:

at least one aperture in said wall element; and a bladder disposed within said wall element between said upper and lower tray, said bladder having an inlet port and an outlet port generally aligned with the at least one aperture in said wall element.

14. A collapsible container system comprising:

a collapsible wall element having four sides; and an interchangeable upper and lower tray, said upper and said lower tray each having a first and second side surface and contour therebetween, said first surface of each of said trays has a plurality of feet extending therefrom, said feet being spaced to accept forks of a forklift therebetween from any side of said upper and lower tray, said feet being positioned to interlock with feet extending from said first surface of the other of said trays, each of said trays having a tray lip extending from a perimeter thereof about said second surface with a configuration adapted to accept said wall element, said tray lip having a plurality of slots adapted to accept straps wherein a portion of each of said slots is aligned with said contour between said first and said second surfaces enabling liquid to drain that may pool within said contour of said second surface.

15. The collapsible container system as claimed in claim 14 wherein said wall element has a cross-fluted configuration.

16. The collapsible container system as claimed in claim 14 wherein said wall element has an inner and outer wall element.

17. A collapsible container system comprising:

first and second opposed interchangeable trays capable of nesting when unopposed, each of said trays having a tray lip disposed along the perimeter thereof extending toward the other of said opposed trays with a plurality of strap slots therein, each of said trays also having a plurality of feet formed therein extending away from the other of said opposed trays with at least one foot proximate each corner thereof, said feet being spaced to accept forks of a forklift therebetween from any side of said first and second tray;

a wall element comprised of a cross-fluted material and having a plurality of sides that engage said tray lip of said first and second opposed trays to form a rigid container; and a plurality of straps capable of being inserted through the plurality of lip slots in said tray lips whereby said straps are arranged to secure said first and second opposed trays and said wall element to each other, straps proximate outer edges of sides of said wall element being suitable to join and extend about adjacent sides of said wall element and about said at least one foot proximate opposed corners of said opposed trays.

18. The collapsible container system of claim 17 wherein said straps are joined with buckles having a slip strength less than a break or tear strength of said lip slots.

19. The collapsible container system of claim 17 wherein an outer surface of said wall element is substantially surrounded by an outer wall element.

* * * * *